United States Patent [19]

Miller

[11] Patent Number: 4,613,431

[45] Date of Patent: Sep. 23, 1986

[54] FROTH FLOTATION SEPARATION APPARATUS

[76] Inventor: Francis G. Miller, P.O. Box 501, Ligonier, Pa. 15658

[21] Appl. No.: 787,263

[22] Filed: Oct. 15, 1985

Related U.S. Application Data

[60] Continuation of Ser. No. 574,869, Jan. 30, 1984, abandoned, which is a division of Ser. No. 679,981, Dec. 10, 1984.

[51] Int. Cl.[4] ..... B03D 1/02

[52] U.S. Cl. ..... 209/169; 209/170

[58] Field of Search ..... 209/169, 170

[56] References Cited

U.S. PATENT DOCUMENTS

| | | | |
|---|---|---|---|
| 2,765,081 | 10/1956 | Evans | 209/164 |
| 3,048,272 | 8/1962 | Miller . | |
| 3,400,818 | 9/1968 | Tarjan | 209/170 |
| 3,446,353 | 5/1969 | Davis | 209/164 |
| 4,220,612 | 9/1980 | Degner et al. | 209/170 |
| 4,477,338 | 10/1984 | Hellman | 209/167 |

FOREIGN PATENT DOCUMENTS

| | | | |
|---|---|---|---|
| 517628 | 10/1955 | Canada | 209/164 |

*Primary Examiner*—Bernard Nozick

*Attorney, Agent, or Firm*—Harry B. Keck

[57] ABSTRACT

An improved froth flotation installation for separating solid particles from an aqueous slurry by delivering a stream of the aqueous slurry directly into a vortex chamber along with a supply of bubble-forming gas. The kinetic energy of the slurry creates necessary froth bubbles, and provides mechanical agitation of the contents of a froth flotation separation zone upon discharge from the bottom of the vortex chamber. In multi-zone froth flotation installations, the direction of flow of the aqueous slurry of unrecovered solid particles is deliberately changed at least twice between a first froth flotation zone and a last froth flotation zone to improve solids-froth contact and to minimize the possibility of particles adopting a short circuit path through the installation. Multiple froth flotation zones are serviced by a single slurry pump in a preferred embodiment.

2 Claims, 13 Drawing Figures

Fig. 1 Prior Art
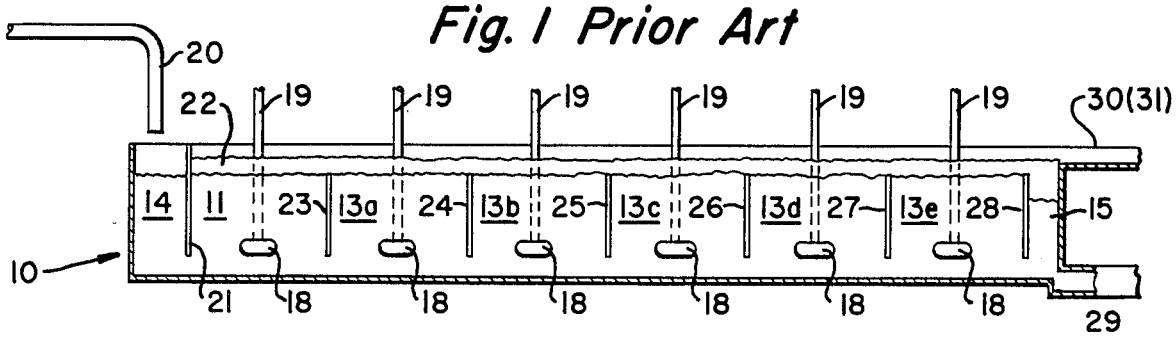
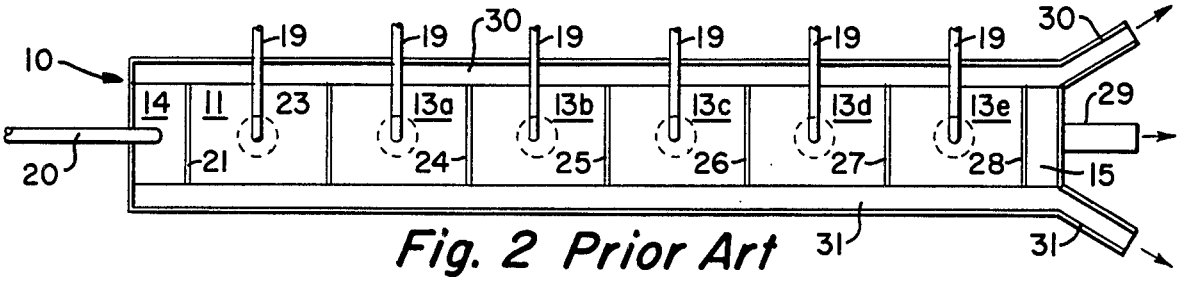
Fig. 2 Prior Art
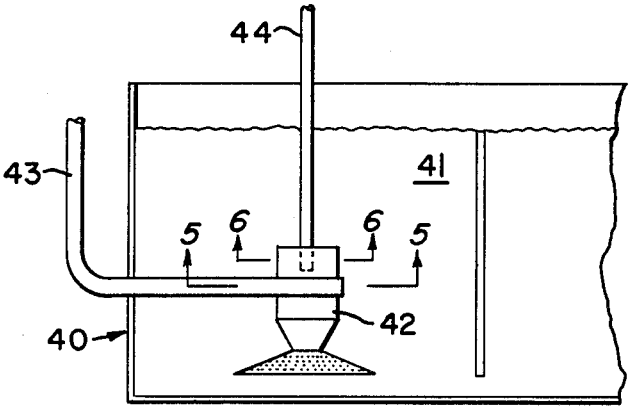
Fig. 3
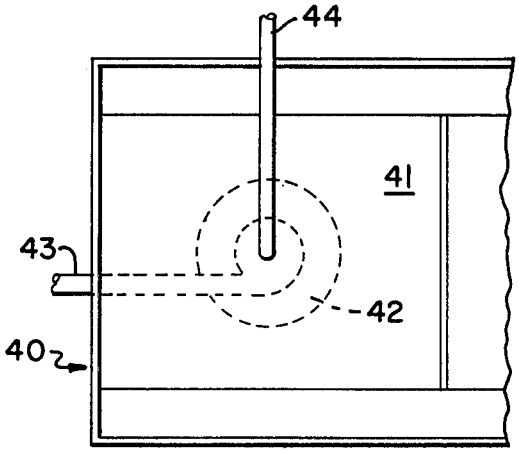
Fig. 4
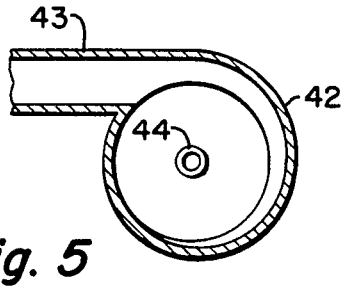
Fig. 5
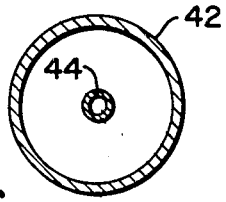
Fig. 6
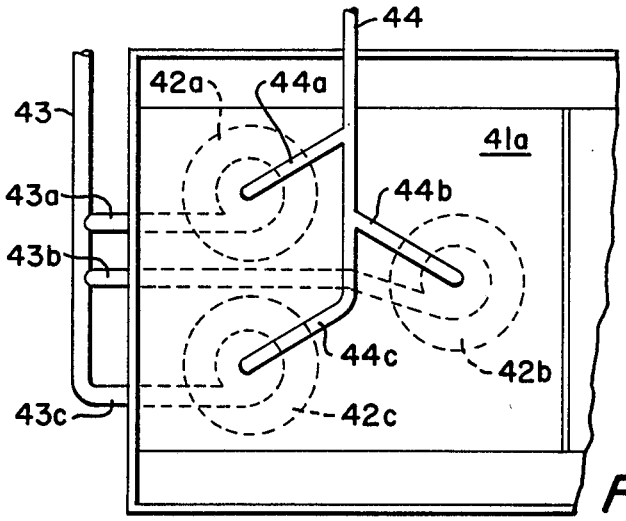
Fig. 4A

FROTH FLOTATION SEPARATION APPARATUS

CROSS REFERENCE TO RELATED APPLICATIONS

This application is a continuation of my copending patent application Ser. No. 574,869 filed Jan. 30, 1984 (now abandoned). A division of the same copending patent application Ser. No. 574,869 was filed on Dec. 10, 1984, Ser. No. 679,981.

BACKGROUND OF THE INVENTION

1. Field of the Invention

This invention relates to froth flotation separation installations and more particularly those froth flotation separation installations wherein a mixture of solid particles is separated into a float product and a non-float (or sink) product during transit as an aqueous slurry through sequential flotation zones in which the aqueous slurry is repeatedly agitated and in which gaseous bubbles are introduced adjacent to the bottom of each flotation zone. The float product passes upwardly through the aqueous slurry with the gaseous bubbles and is collected as a froth above the upper surface of the aqueous slurry. The aqueous slurry which is not recovered as a float product is recovered as a non-float (or sink) product.

2. Description of the Prior Art

Froth flotation installations are widely used in the mineral separation industries for separating solid raw materials into a useful product and a waste product according to the difference in the physical properties of the materials, especially the surface properties of the raw materials. Froth flotation is extensively used to concentrate coal or mineral sulfides and oxides. Finely ground ores or coal have particles with different surface properties with respect to water, i.e., some particles are hydrophilic and some particles are hydrophobic. In some ores, all of the particles are hydrophilic in varying degrees. The differential in hydrophilic characteristics permits separation of the more hydrophilic particles from the less hydrophilic particles. The finely divided fresh particles are agitated in water with air bubbles. The bubbles and the particles combine and rise to the surface of the aqueous slurry as a frothy concentrate which can be skimmed for collection above the level of the aqueous slurry of unrecovered particles. The more hydrophilic particles remain in the aqueous slurry and are recovered as a sink product.

Various chemical reagents are added to the froth flotation installations to improve the recovery. These reagents are frothing agents which alter the surface tension of the water and thus promote small bubble formation;

collectors which improve the attachment of particles to bubbles and assist in forming a stable froth;

activators which improve the performance of the collectors;

depressants which selectively interfere with the effectiveness of the collectors.

While the present invention is applicable to separation of mineral ores, its application to coal separation will be discussed in detail for simplicity. Coal which is to be separated in froth flotation equipment is customarily ground to fine particle size, for example, 0.75 millimeters. The fine particles of coal are delivered as an aqueous slurry as raw fine coal or obtained from prior separation equipment (e.g., centrifugal separators such as hydrocyclones, screens, etc.). The function of the froth flotation process is to recover two distinct products. The float product contains most of the combustible ingredients of the raw coal and generally has a reduced sulfur content and a reduced ash content when compared with the raw coal. The non-float (or sink) product contains less combustible ingredients, more ash ingredients and generally more sulfur ingredients than the raw coal.

Typically the froth flotation process is carried out in a number of sequential flotation cells wherein an aqueous slurry of raw coal solids is introduced into a first froth flotation cell and subjected to agitation with rising gas bubbles to permit flotation of the more hydrophobic particles for recovery as a froth above the liquid surface of the aqueous slurry of unrecovered solids. The aqueous slurry of unrecovered solids moves from the first flotation zone to a second flotation zone where the slurry is again agitated with freshly created upwardly rising gas bubbles to effect further separation of the more hydrophobic particles. An aqueous slurry of unrecovered, non-float solids passes from the second flotation zone through succeeding intermediate flotation zones, if any, where the agitation of the aqueous slurry of unrecovered solids with upwardly rising freshly created gas bubbles is repeated and froth containing the more hydrophobic particles is recovered above the level of the slurry of unrecovered, non-float solids.

The aqueous slurry of unrecovered, not-float solids from the last of the intermediate flotation zones is delivered to the last flotation zone where a final agitation of the aqueous slurry with freshly created rising gas bubbles is carried out. The more hydrophobic remaining particles rise upwardly along with gas bubbles in the last flotation zone. An aqueous slurry of unrecovered, non-float solid particles from the last flotation zone is separately recovered as the non-float (or sink) product of the process. One of the shortcomings of the sequential froth flotation separation process is the amount of energy required to agitate the aqueous slurry of unrecovered solids and to generate fresh gas bubbles near the bottom of each individual flotation zone. A typical agitation/bubble formation involves a motor-driven mechanical agitator in the central region of each individual flotation zone for creating agitation and aeration in the aqueous slurry. The energy required in each of the flotation zones is appreciable and significantly affects the cost of the separation process.

Another phenomenon associated with froth flotation is the increasing difficulty of establishing efficient separation in succeeding froth flotation zones. In the initial froth flotation zone, the incoming raw coal solids have a substantial fraction of particles which will enter into the float product. However as these float product particles are removed from the first flotation zone, there are fewer float product particles remaining in the aqueous slurry of unrecovered solids which is delivered to each succeeding flotation zone. Each succeeding flotation zone requires greater energy to create additional agitation and aeration to achieve the more difficult separations. The recent history of froth flotation installations shows that the energy of the agitation apparatus is not increased in response to this need for progressively higher energy from feed to tailings. Instead, common practice has been to install long lines of smaller agitation apparatus, each with about equal energy requirements. By providing more froth flotation zones, each with a smaller agitator apparatus, high separation efficiencies can be maintained but at a sacrifice of greatly increased length of the froth flotation installation with resulting higher cost. Hence, to reduce the higher costs, the current practice is to increase the size of the agitator-aerators, and to increase the size of the flotation zones, but to shorten the length of the froth flotation installation. The reduction in overall length decreases investment expenses and reduces building requirements and energy consumption. However, separation efficiency, resulting from shorter length and lower energy, may be adversely affected.

One of the devices heretofore employed in froth flotation units is a vortex chamber which receives pressurized liquid from a tangential entry pipe and delivers a single bottom liquid product with great turbulence. The vortex chamber also functions as an aspirator for flotation gas and hence comprises a single unit which achieves the requisite agitation and flotation gas bubble formation within a froth flotation cell. The aqueous slurry introduced into such vortex chambers heretofore is a side stream of aqueous slurry of unrecovered solids drawn from one of the intermediate froth flotation zones or from the last froth flotation zone.

A vortex chamber has a cylindrical body, an inverted conical frustum base, a top central pipe extending into the interior and at least one tangential feed conduit. Liquids at elevated pressure are delivered through the tangential feed conduit into the cylindrical body to create a vortex therein. All of the liquids are discharged through an opening at the bottom of the conical frustum base. Gases are aspirated into the vortex through the top control pipe so that the discharged liquids contain dispersed gas bubbles. Vortex chambers also are called aeration chambers or aeration and agitation chambers. Multiple tangential feed conduits might be employed for the vortex chamber as suggested in U.S. Pat. No. 4,090,956.

Heretofore the aqueous slurry of raw coal solids has been delivered to the first froth flotation zone from a collector box which is reasonably non-turbulent. The flow velocity of the incoming aqueous slurry of raw solids has been intentionally dissipated in the relatively non-turbulent collector box.

The expression "raw coal" in this specification includes freshly mixed coal, also coal which has received some preliminary separation processing and also coal which is recovered from silt ponds and similar accumulations of fine coal previously considered to be unsuitable for recovery.

STATEMENT OF THE INVENTION

The present invention is an improved method and apparatus for froth flotation and more particularly for froth flotation in multiple sequential froth flotation zones.

In one embodiment of the invention, the incoming aqueous slurry of raw coal solids is delivered at an elevated pressure as the feed stream for a vortex chamber serving as the agitator/bubble generator in a first froth flotation zone. Frequently the aqueous slurry of raw coal solids which is to be separated in the froth flotation installation is developed in a coal separation plant at an elevated level above the level of the froth flotation installation.

The present invention contemplates, in a preferred embodiment, exploiting the potential energy of the elevated aqueous slurry of raw coal solids by delivering the aqueous slurry of raw coal solids directly into a vortex chamber in a first froth flotation zone to create turbulence and generate flotation gas bubbles. An elevation head of 15 feet or more is sufficient to provide for the energy requirements of a first froth flotation zone. It must be remembered that the separation occurring in a first froth flotation zone is relatively easy because the raw coal solids in the first froth flotation zone contain a substantially higher fraction of float particles than any sequential zone in a multi-zone froth flotation installation. Thus, while the total energy input into the first froth flotation zone may be significantly less than the energy input for subsequent froth flotation zones, no extrinsic energy will be required if the elevation height of the aqueous slurry of raw coal is adequate. In the event the elevation height of aqueous slurry of raw coal is inadequate, additional energy may be introduced into the incoming stream of aqueous slurry of raw coal solids by direct pumping or by deliberately raising the stream to a suitable elevation to provide the requisite elevation head to ahieve the desired separation efficiencies in the first froth flotation zone.

According to an alternative embodiment of the present invention, a multi-zone froth flotation installation is provided with at least four stages including a first froth flotation zone, a last froth flotation zone and at least two intermediate froth flotation zones. The aqueous slurry moves from the first froth flotation zone through the intermediate froth flotation zones and through the last froth flotation zone from which the non-float (or sink) product is recovered. The direction of flow of the aqueous slurry through intermediate froth flotation zones changes at least twice between the first froth flotation zone and the last froth flotation zone. The cross-sectional flow area available to the aqueous slurry is correspondingly reduced in transit through the intermediate froth flotation zones whereby multiple froth flotation zones can be arranged between a first froth flotation zone and a last froth flotation zone without greatly increasing the linear distance between the first froth flotation zone and the last froth flotation zone. Hence the overall length of the froth flotation installation is appreciably reduced in comparison to the length of corresponding multi-zone froth flotation installations of the prior art. By this novel flow direction change, lower overall energy input into the froth flotation installation can be achieved. Also the invention achieves improved mixing and increases the gas bubble contacts with solid particles. Further, the agitation and gas flotation bubble-forming devices in the intermediate froth flotation zones can be manifolded compactly whereby the overall system can be operated efficientl with a single slurry recycle pump. The invention also permits a simplified controlled application of energy to each of the sequential froth flotation zones to achieve optimum separation effectiveness in each froth flotation zone.

It should be appreciated that the two embodiments of the present invention have independent advantages, namely, the direct introduction of an aqueous slurry of raw coal into a vortex chamber functioning as an agitator/bubble generator in a single froth flotation zone is useful without regard to the nature of the sequential froth flotation zones, if any. Conversely changing the flow direction in intermediate froth flotation zones between a first froth flotation zone and a last froth flotation zone introduces advantages regardless of the nature of the agitator/bubble generator device and regardless of the manner in which the aqueous slurry of raw coal solid is introduced into the first froth flotation zone. The preferred embodiment of the invention combines both of these embodiments.

DESCRIPTION OF THE DRAWINGS

FIG. 1 is a schematic side elevation view of a multi-zone froth flotation installation of the prior art.

FIG. 2 is a schematic plan view of the prior art multi-zone froth floation installation of FIG. 1.

FIG. 3 is a schematic side elevation view of a first froth flotation zone according to one embodiment of the present invention.

FIG. 4 is a schematic plan view of a first froth flotation zone illustrated in FIG. 3.

FIG. 4A is a schematic plan view of a first froth flotation zone as illustrated in FIG. 4 employing more than one vortex chamber.

FIG. 5 is a cross-section taken along line 5—5 of the vortex chamber of FIG. 3.

FIG. 6 is a cross-section of the vortex chamber taken along the lines 6—6 of FIG. 3.

DESCRIPTION OF THE INVENTION

Figure 7:
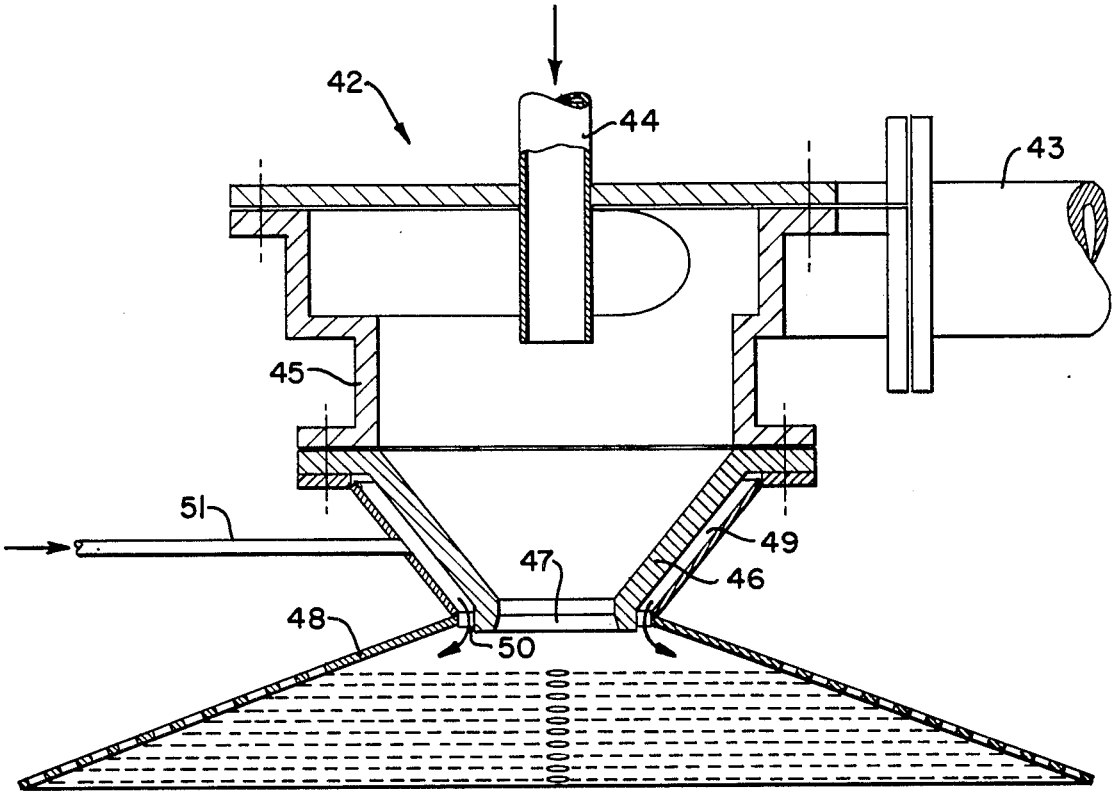
FIG. 7 is a cross-section illustration of a vortex chamber of the type which is employed in the present invention as a combination agitator and flotation gas bubble generator.

Detailed Discussion of Prior Art: FIGS. 1 and 2 illustrate a typical multi-zone froth flotation installation 10 of the prior art including a first froth flotation zone 11, a last froth flotation zone 12 and intermediate froth flotation zones 13*a*, 13*b*, 13*c*, 13*d*. A feed collector zone 14 preceeds the first froth flotation zone 11. A non-float (or sink) collector 15 follows the last froth flotation zone 12. A froth collecting trough 16, 17 is provided on each side of the installation 10 to receive froth overflowing from each of the froth flotation zones 11, 12, 13. Each of the froth flotation zones 11, 12, 13 is provided with an agitator/bubble generator device 18.

A vortex chamber as defined herein is the preferred agitator/bubble generator device. Mechanical powered impellers with appropriate gas supply may be used as the agitator/bubble generator device. One or more gas nozzles may be employed to create turbulence and gas bubbles; such systems are known as pneumatic cells.

A gas inlet pipe 19 is provided for introducing flotation gas, normally air, into the agitator/bubble generators 18. An inlet pipe 20 is provided to introduce an aqueous slurry of raw coal into the feed collector zone 14 where any kinetic energy of the aqueous slurry of raw coal is dissipated.

A baffle 21 separates the collector 14 from the first froth flotation zone 11 to permit the aqueous slurry of raw coal to enter from the feed collector 14 into the first froth flotation zone 11 along the bottom of the first froth flotation zone 11 into proximity with the agitator/bubble generator 18 in the first froth flotation zone 11. The agitator/bubble generator 18 creates liquid turbulece within the first froth flotation zone 11 and creates great quantities of upwardly rising gas bubbles. The least hydrophilic solids from the slurry in the first froth flotation zone 11 tend to combine with the bubbles and float upwardly to form a blanket of froth 22 above all of the froth flotation zones 11, 12, 13.

The first froth flotation zone 11 is separated from its succeeding intermediate froth flotation zone 13*a* by means of a baffle 23 which is open at the bottom to permit flow of water and solid particles which did not rise upwardly into the froth blanket 22. Similar baffles 24, 25, 26, 27 are provided to define the intermediate froth flotation zones 13*a*, 13*b*, 13*c*, 13*d*. Each of the baffles 24, 25, 26, 27 is open at the bottom to permit underflow of aqueous slurry of solid particles which have not risen into the froth blanket 22. In some installations, some of the baffles 21, 23, 24, 25, 26, 27 are not provided and the aqueous slurry moves unobstructedly between froth flotation zones. The underflow slurry encounters an agitator/bubble generator 18 in each of the intermediate froth flotation zones 13*a*, 13*b*, 13*c*, 13*d*. The underflow from the last intermediate froth flotation zone 13*d* moves beneath the baffle 27 into proximity with the agitator/bubble generator 18 in the last froth collection zone 12. An aqueous slurry of solid particles which have not entered into the froth blanket 22 is withdrawn beneath a baffle 28 into the non-float (or sink) collector 15, from which the aqueous stream of sink product is recovered through a conduit 29.

The froth blanket 22 flows over the sides of the froth flotation zones 11, 12, 13 into the froth collection troughs 16, 17 from which the froth is collected through troughs 30, 31, respectively.

According to the prior art as developed in FIG. 1 and 2, an aqueous slurry of raw coal introduced through the feed conduit 20 is separated in a typical froth flotation installation 10 into a float product at the collecting troughs 30, 31 and a non-float (or sink) product in the conduit 29. The float product contains a lower ash content and generally a lower sulfur content than the non-float (or sink) product. The float product also contains more combustible ingredients than the non-float (sink) product.

Each of the agitator/bubble generators 18 requires energy for operation. As shown in FIG. 1 and 2, there are six sequential, in-line froth flotation zones 11, 13*a*, 13*b*, 13*c*, 13*d*, 12, each of which requires energy inputs to operate an agitator/bubble generator 18 therein.

In order to minimize the number of intermediate froth flotation zones 13, the trend in the froth flotation art is to employ larger agitator/bubble generators 18 which have significantly larger and more expensive energy requirements than each of the smaller agitator/bubble generators 18. However the total energy requirement of the large agitator/bubble generators is less than the energy requirement of the greater number of smaller agitator/bubble generators. As a result overall energy requirement is reduced, but because of the shorter length of the installations having larger machines, the larger-short installations tend to be somewhat less efficient than the smaller-long installations.

It is an object of this invention to provide the separation efficiency associated with the smaller-long machine installations and to retain the dimensions and the energy efficiency of the larger-short installations.

The First Embodiment

The first embodiment of the present invention is illustrated in FIG. 3, 4, 4A, 5, 6 wherein a first froth flotation zone 41 of a froth flotation installation 40 is provided with a vortex chamber 42 which functions as a combined agitator/bubble generator. Such vortex chamber devices 42 have been manufactured and used as agitator/bubble generators heretofore. They are illustrated more fully in FIG. 7.

The aqueous slurry of raw coal solids is introduced through an inlet conduit 43 tangentially into a vortex chamber 42 with sufficient velocity to create turbulence and to aspirate bubble-forming gases from a gas inlet conduit 44 containing gas at about 2 psig. The aqueous slurry of raw coal solids along with small bubbles is discharged through the base of the vortex chamber 42 whence the bubbles rise upwardly toward the surface of the first froth flotation zone 41. The vortex chamber 42 is more fully illustrated in FIG. 7 as having a generally cylindrical body portion 45 connected to an inverted conical frustum 46 having a bottom opening 47. The gas inlet conduit 44 extends downwardly into the cylindrical portion 45 at the center thereof. A conical frustum-shaped shroud 48 is secured around the opening 47. A conical annular gas chamber 49 surrounds the outer surface of the conical frustum portion 46 to serve as a manifold for introducing gas through bottom openings 50 beneath the narrow upper surface of the conical frustum-shaped shroud 48. Bubble forming gas is introduced into the conical annular passageway 49 through a gas inlet pipe 51.

The conical frustum-shaped shroud 48 is perforated at its widest portion and is preferably imperforate at its narrow portion.

A typical vortex chamber has a cylindrical portion 45 about 12 inches inner diameter and about 8 inches top-to-bottom. A corresponding conical frustum portion 46 is about 6 inches top-to-bottom. The inlet conduit 43 is about 4 inches inner diameter. The bottom opening 47 is about 4 inches inner diameter and is outwardly flared at approximately 15 degrees. The shroud 48 has a major diameter of about 36 inches and a cone angle of about 140 degrees. The cylindrical portion 45 and the conical frustum portion 46 are fabricated from metals, usually stainless steel. The shroud 48 may be fabricated from glass fiber reinforced plastics such as polyester or polyurethane.

In operation, an aqueous slurry of raw coal solids is introduced at a suitable pressure, e.g., 10 to 30 psig, from the inlet conduit 43 tangentially into the cylindrical portion 45 and thereupon downwardly through the conical frustum 46 and outwardly through the bottom opening 47. The reduced pressures within the vortex chamber 42 will cause aspiration of bubble forming gases from the gas inlet pipe 44. The energy released from the vortex chamber 42 will create small gas bubbles. Some of the gas bubbles pass upwardly through the openings in the perforated conical frustum-shaped shroud 48. Other gas bubbles continue downwardly with the rapidly agitated aqueous slurry of raw coal solids and rise upwardly outside the perimeter of the conical frustum-shaped shroud 48. Additional bubble forming gas may be introduced through the gas inlet pipe 51 to a conical, annular manifold chamber 49 whence the gas is delivered downwardly throug openings 50 to create additional gas bubbles for froth separation.

Preferably, the agitator/bubble generator apparatus 18 which appear in intermediate froth flotation zones and in the last froth flotation zone will have the same appearance as the vortex chamber 42 except that the incoming stream of aqueous slurry will be a stream which is drawn from one or more of the intermediate flotation zones or from the last froth flotation zone and pressurized in an appropriate pump hereinafter to be described.

It may be desirable in some installations to employ more than one vortex chamber in the first froth flotation zone, each of which receives aqueous slurry of raw coal under pressure, preferably from an elevated location. This alternative system which employs multiple vortex chambers in the first froth flotation zone illustrated in FIG. 4A wherein the first froth flotation 41A contains three vortex chambers 42*a*, 42*b*, 42*c*, each of which receives an aqueous slurry of raw coal from a coal feed inlet pipe 43 through inlet pipes 43*a*, 43*b*, 43*c*, respectively. Each of the vortex chambers receives bubble-forming gas from a pipe 44 through separate conduits 44*a*, 44*b*, 44*c*. One of the advantages of employing multiple vortex chambers in the first froth flotation zone is that smaller vortex chambers can be produced and installed at a substantial cost savings when compared to the cost of large vortex chambers. While three vortex chambers are illustrated in FIG. 4A, it should be apparent that two such vortex chambers or four or more such vortex chambers might be employed in the first froth flotation zone 41*a* in order to take advantage of the present invention.

Thus according to one embodiment of this invention, the initial froth flotation zone is operated from the kinetic energy of the incoming aqueous slurry of raw coal solids.

Froth Flotation Zone Geometry

Figure 8:
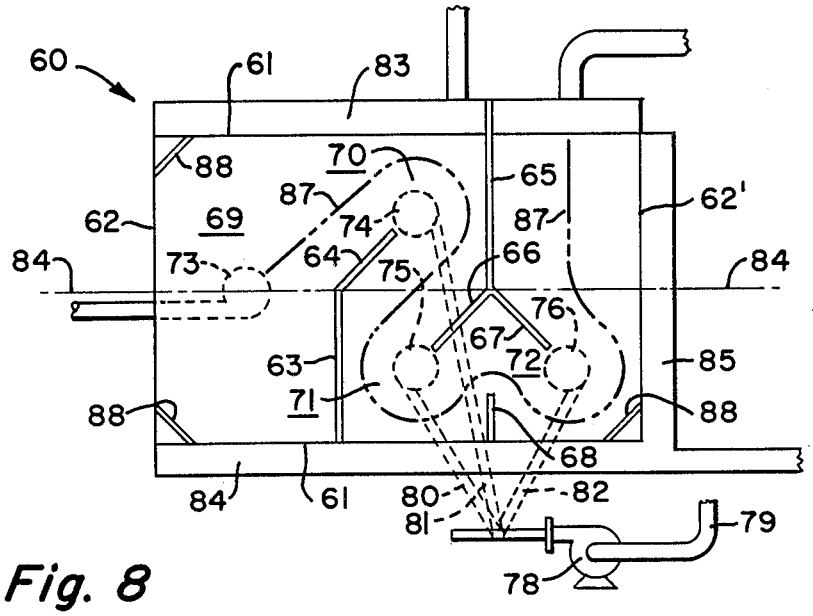
FIG. 8 is a schematic plan view of a multi-zone froth flotation installation.
Figure 9:
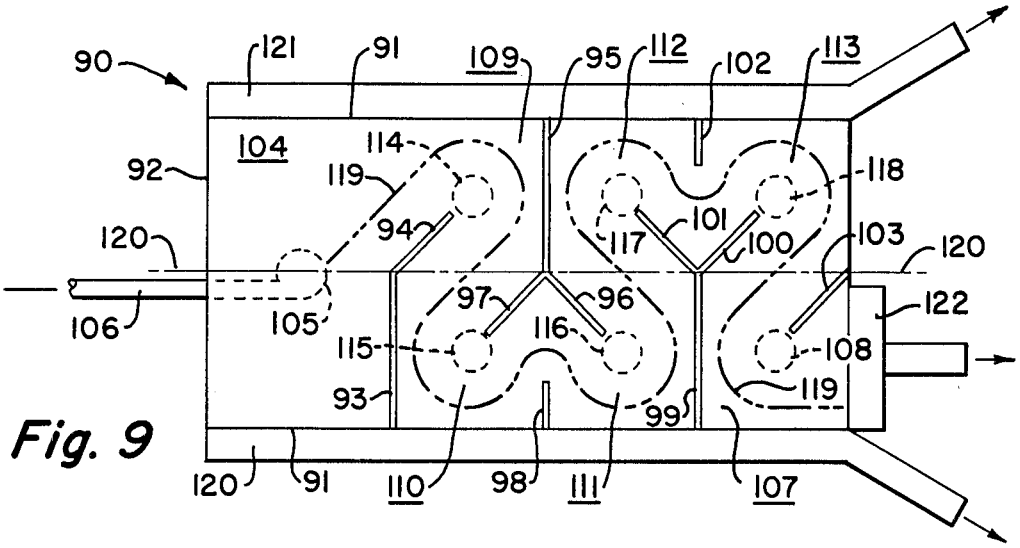
FIG. 9 is a schematic plan view of an alternate embodiment of a multi-zone froth flotation installation.

Referring to FIGS. 8 and 9, there is illustrated in plan view an improved froth flotation installation according to an alternative embodiment of this invention. FIG. 8 illustrates a four stage separation system contained in a generally rectangular tank 60 having a long side 61 and short sides 62, 62'. Vertical baffles 63, 64, 65, 66, 67, 68 divide the interior of the tank 60 into a defined flow path having characteristics which will hereinafter be described. The tank 60 includes a first froth flotation zone 69, an intermediate froth flotation zones 70, 71 and a last froth flotation zone 72. The first froth flotation zone 69 includes a first agitator/bubble generator 73. The intermediate froth flotation zone 70, 71 include an intermediate agitator/bubble generators 74, 75. The last froth flotation zone 72 includes a last agitator/bubble generator 76. The first agitator/bubble generator 73 preferably is operated by means of incoming aqueous slurry of raw coal solids introduced through a conduit 77 although other sources of aqueous energy may be employed.

A pump 78 which withdraws aqueous slurry of unfrothed solids from one or more locations in the tank 60 through conduit 79 and introduces pressurized aqueous slurry through conduits 80, 81, 82 to agitator/bubble generators 74, 75, 76, respectively. Appropriate froth collector troughs 83, 84, 85 are provide along the sides 61 and 62' of the tank 60. An appropriate non-float (sink) product collector 86 communicates with the last froth flotation zone 72.

It will be observed from FIG. 8 that incoming raw coal passes sequentially along the heavy dash/dot line 87 through the tank 60 and sequentially through the froth flotation zones 69, 70, 71, 72. The flow path 87 experiences directional changes between the first froth flotation zone 69 and the last froth flotation zone 72. The flow path 87 has a reduced cross-sectional flow area between the first froth flotation zone 69 and the last froth flotation zone 72. This unique flow direction change permits use of relatively smaller agitator/bubble generators 74, 75, 76 without increasing the length of the side 61 of the froth flotation tank 60. Small baffles 88 may be provided to eliminate sharp corners where objectionable solids accumulations might otherwise develop.

It will be observed that the non-float (sink) collector 86 in FIG. 8 is presented along one of the sidewalls 61. Accordingly a froth collecter trough 85 is provided along the end wall 62'. As an alternative the non-float (sink) product collector 86 could be positioned along the end wall 62' remote from the agitator/bubble generator 76. In such alternative installation, the froth collector trough 83 would extend for the entire length of the sidewall 61.

A further alternative embodiment in FIG. 9 includes a tank 90 having a long edge 91 and a short edges 92, 92'. Baffles 93, 94, 95, 96, 97, 98, 99, 100, 101, 102, 103 divide the interior of the tank 90. A first froth flotation zone 104 includes a first agitator/bubble generator 105 which is preferably powered by kinetic energy of an aqueous slurry of raw coal solids through a conduit 106. A last froth flotation zone 107 includes a last agitator/-bubble generator 108. Intermediate froth flotation zones 109, 110, 111, 112, 113 are provided with corresponding agitator/bubble generators 114, 115, 116, 117, 118. A mean flow path for aqueous slurry through the froth flotation installation of FIG. 9 is shown by the heavy dash/dot line 119. The mean flow path 119 experiences numerous directional changes between the first froth flotation zone 104 and the last froth flotation zone 107 whereby, as shown in FIG. 9, five intermediate froth flotation zones are accommodated in the length of the long side 91.

Froth collecting troughs 120, 121 are provided along each of the long sides 91. Each of the froth flotation zones 104, 109, 110, 111, 112, 113 and 107 is in contact with at least one of the froth collector troughs 120, 121. A sink product collector 122 communicates with the last froth flotation zone 107.

Vertical planes 84 (FIG. 8) and 120 (FIG. 9) are midway between sidewalls 61 (FIG. 8) and 91 (FIG. 9). Note that the baffles 63, 60, and 65, 66, 67 of FIG. 8 extend from a sidewall toward the opposite sidewall past the vertical midplane 84. Similarly, the baffles 93, 94 and 95, 96, 97 and 99, 100, 101 of FIG. 9 extend from a sidewall 91 toward the opposite sidewall past the vertical midplane 120.

It will be observed by inspecting FIGS. 8 and 9 that the flow reversal through the froth flotation installation permits the use of multiple agitator/bubble generator devices in a relatively short length 61 (of tank 60) or 91 (of tank 90). In addition to increasing the contact of aqueous slurry with agitator/bubble generator devices, the improved flow pattern permits economies in consolidating the froth flotation installation, particularly where the agitator/bubble generator devices are vortex chambers of the type already described herein. By advancing aqueous slurry of unrecovered particles through the intermediate froth flotation zones with the directional changes, improved mixing is achieved and the bubble contact with suspended solids is improved.

The first froth flotation zone 69 (FIG. 8) and 104 (FIG. 9) is larger than the succeeding froth flotation zones whereby the mean residence time of the aqueous slurry is greater in the first froth flotation zone than in the succeeding froth flotation zones.

Note that the flow passageway for the aqueous slurry through the intermediate froth flotation zones is less than one-half the distance between the sidewalls 61 (FIG. 8) and 91 (FIG. 9).

Alternative Embodiments

While the improved flow pattern for a froth flotation installation of FIGS. 8 and 9 has been described with vortex chambers as the agitator/bubble generator devices, it should be apparent that the improved froth flotation installation also can employ other types of agitators and bubble generators with corresponding benefits. Other types of useful agitator/bubble generators include mechanical impellers and air nozzles.

Figure 10:
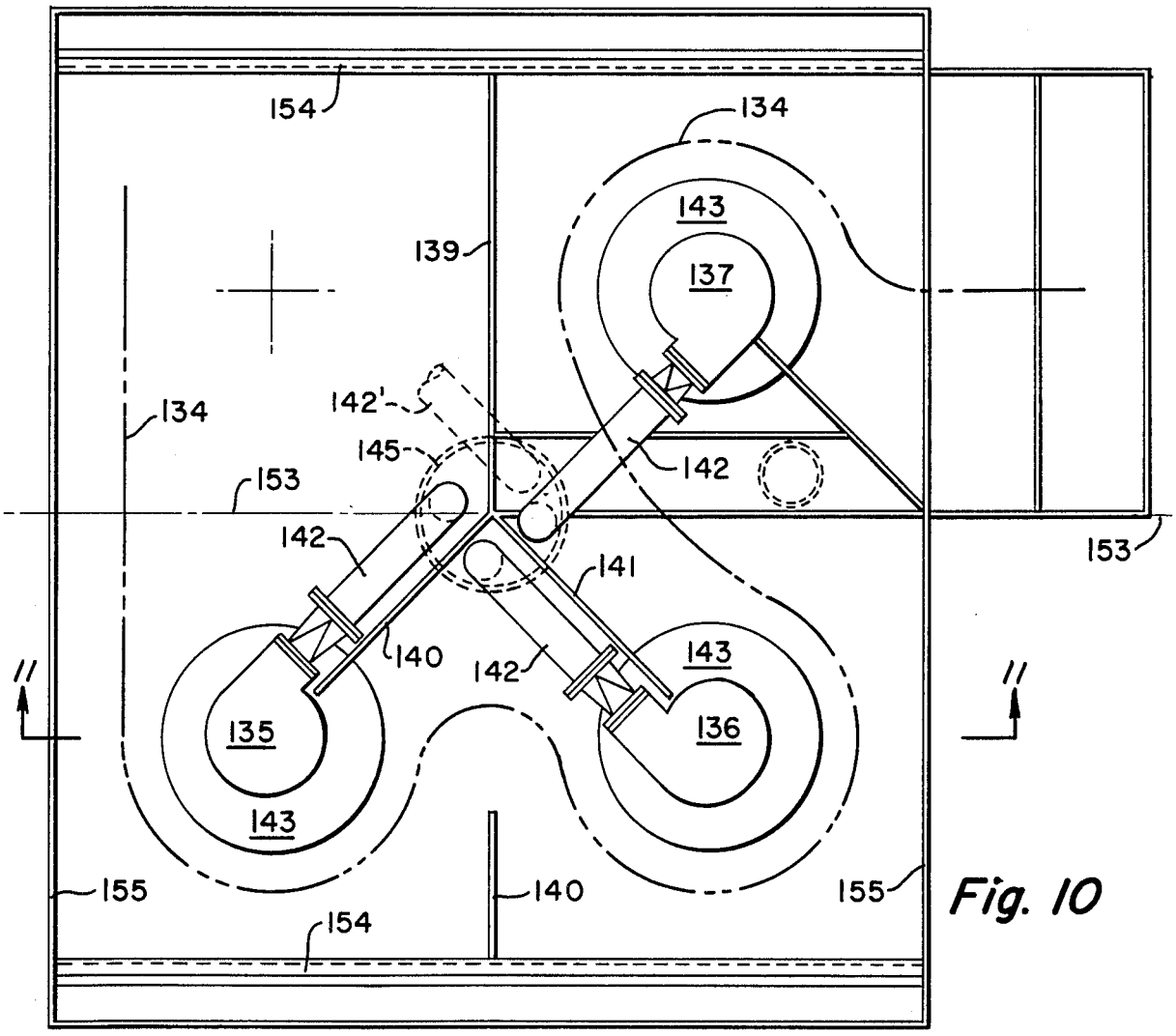
FIG. 10 is a plan view of a further embodiment of a multistage froth flotation installation.
Figure 11:
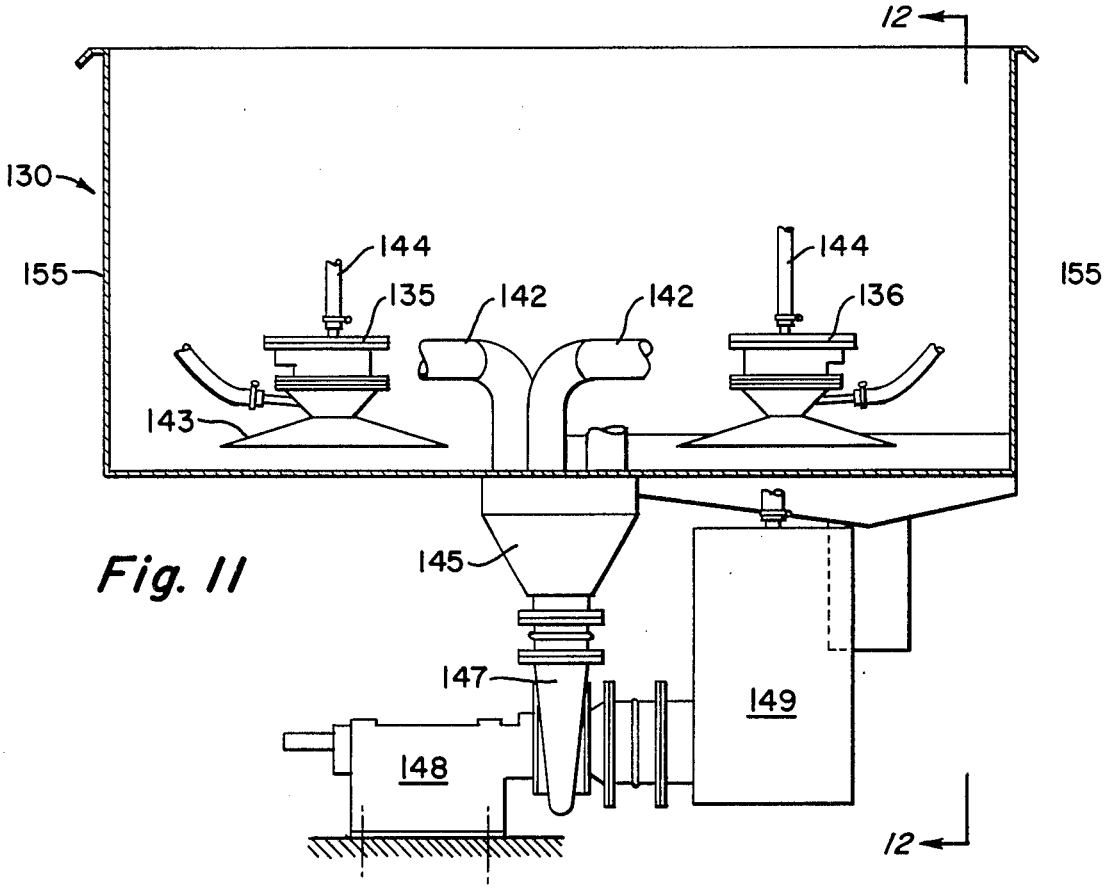
FIG. 11 is a side elevation view taken along the line of 11—11 of FIG. 10.
Figure 12:
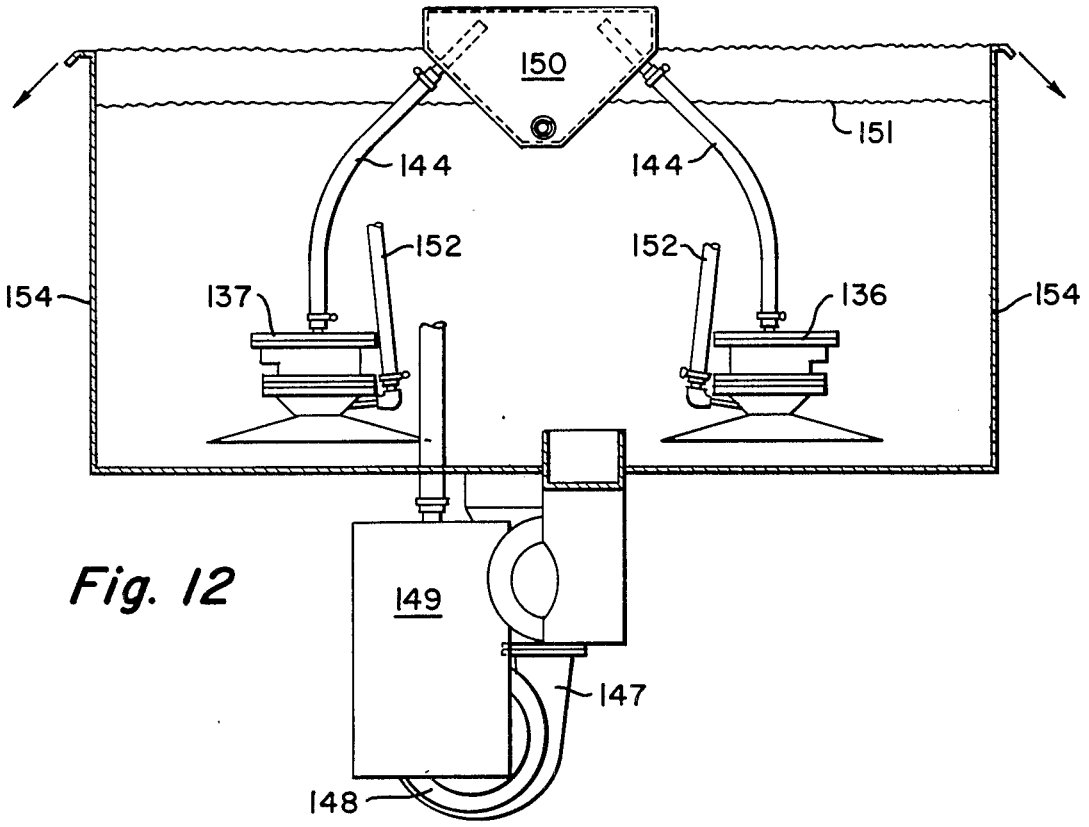
FIG. 12 is an end view of the multi-zone froth flotation installation of FIG. 10 taken along the line 12—12 of FIG. 11.

When the present invention employs the vortex chambers according to the preferred embodiment, further substantial economies can be achieved as illustrated in FIGS. 10, 11, 12. FIG. 10 illustrates a froth flotation installation 130 including (insofar as shown in FIG. 10) two intermediate froth flotation zones 131, 132 and a last froth flotation zone 133. A vortex chamber 135, 136, 137 is provided in the froth flotation zones 131, 132, 133, respectively. Appropriate baffles 139, 140, 141 provide a desired flow pattern as shown in the heavy dash/dot line 134.

Each of the vortex chambers 135, 136, 137 has a slurry inlet pipe 142, a bottom skirt 143, and a gas inlet pipe 144.

The slurry inlet pipes 142 communicate with a distributor box 145 which is positioned beneath a bottom wall 146 of the froth flotation installation 130. The distributor box 145 is connected to an outlet conduit 147 from a pump 148 which draws aqueous slurry from selected locations in the froth flotation installation 130 through a deaerator chamber 149. Thus with a single pump 148, an appropriate aqueous slurry can be delivered through the slurry inlet pipes 142 to three vortex chambers 135, 136, 137 and, if desired, to an additional vortex chamber (not shown) through a slurry inlet pipe 142' which is illustrated in phantom outline in FIG. 10.

A vertical plane 153 in FIG. 10 is midway between sidewalls 154. The baffle 139, 140, 141 extends from one sidewall 154 toward the opposite sidewall past the vertical midplane 53.

By combining the multiple vortex chambers in the manner illustrated in FIGS. 10, 11, 12, significant economies in equipment cost and operating expenses can be achieved. It is possible to alter the flow rate of aqueous slurry entering each of the vortex chambers 135, 136, 137 and thereby provide an appropriate energy input for each of the vortex chambers. Flow control means, such as an orifice plate or other valve device can be installed in the slurry inlet pipes 142. Preferably the last vortex chamber 137 will receive the greatest energy input, i.e., the greatest flow velocity of aqueous slurry. The intermediate vortex chamber 136 will receive more energy than the proceeding vortex chamber 135.

As shown in FIG. 12, the gas inlet pipes 144 preferably are connected to a hollow manifold chamber 150 which is positioned at the level of a froth-slurry interface 151. The manifold chamber 150 preferably is a part of a structure known as a crowd-board which has been employed in froth flotation installations of the prior art to preclude accumulation of froth in the quiescent space in the center of a froth flotation unit. The crowd-board is a hollow inverted pyramid which directs flow of froth toward the edges of the froth flotation unit. In the preferred embodiment of FIG. 12, the manifold chamber 150 functions not only as a crowd-board but also as a plenum chamber for the bubble forming gases, usually air.

Supplemental bubble forming gas may be introduced through pipes 152.

Typically a froth flotation installation of FIGS. 10, 11, 12 will be confined between sidewalls 154 about 12 feet long and end walls 155 about 12 feet long. The vertical height of the sidewalls 154 is about 5 feet.

I claim:

1. In a froth flotation tank for separating solids into a float product and a non-float product including a plurality of directly communicating sequential froth flotation zones, a plurality of vertical baffles defining the said sequential froth flotation zones, each said zone containing aqueous slurry of unrecovered solids; each of said froth flotation zones including means for agitating the said aqueous slurry, means for introducing froth flotation gas and means for forming bubbles of said froth flotation gas; means for collecting the said float product from said froth flotation zones; feed means for introducing an aqueous slurry of said solids into a first of said froth flotation zones; unobstructed passageway means between said baffles for delivering aqueous slurry of unrecovered solids sequentially through the successive froth flotation zones; means in the last of said froth flotation zones recovering the said non-float product; the improvement comprising:

the said first froth flotation zone is larger than any of the successive froth flotation zones in the froth flotation tank whereby the mean residence time of said aqueous slurry is longer in the said first froth flotation zone than in any of the successive froth flotation zones in the said froth flotation tank; and the said mens for agitating and the said means for introducing froth flotation gas in said first zone introduce less energy per unit volume of aqueous slurry therein than the said means for agitating and the said means for introducing froth flotation gas introduce in any of said successive froth flotation zones.

2. The froth flotation system of claim 1 wherein a vortex chamber is the said means for agitating the said aqueous slurry and is the said means for introducing froth flotation gas.

* * * * *